US006609933B2

(12) United States Patent
Yamasaki

(10) Patent No.: US 6,609,933 B2
(45) Date of Patent: Aug. 26, 2003

(54) SHIELD CONNECTOR

(75) Inventor: Shuji Yamasaki, Iwate (JP)

(73) Assignee: NEC Tokin Iwate, Ltd., Ichinoseki (JP)

( * ) Notice: Subject to any disclaimer, the term of this patent is extended or adjusted under 35 U.S.C. 154(b) by 0 days.

(21) Appl. No.: 10/187,985

(22) Filed: Jul. 3, 2002

(65) Prior Publication Data

US 2003/0008562 A1 Jan. 9, 2003

(30) Foreign Application Priority Data

Jul. 4, 2001 (JP) ..... 2001-203334

(51) Int. Cl.[7] ..... H01R 13/648
(52) U.S. Cl. ..... 439/608
(58) Field of Search ..... 439/608, 609, 439/95

(56) References Cited

U.S. PATENT DOCUMENTS 5,620,340 A * 4/1997 Andrews ..... 439/108
6,183,301 B1 * 2/2001 Paagman ..... 439/567
6,220,896 B1 * 4/2001 Bertoncini et al. ..... 439/608

* cited by examiner

*Primary Examiner*—Neil Abrams
*Assistant Examiner*—Phuong K T Dinh
(74) *Attorney, Agent, or Firm*—McGinn & Gibb, PLLC

(57) ABSTRACT

To provide a shield connector which effectively suppresses cross-talk. The shield connector includes a plural number of contact units, mounted side-by-side in a housing, for arraying and holding a plural number of terminals at optimum positions by insulating member(s), electrically conductive shield plates, mounted to the insulating member of the contact unit, for extending to the vicinity of foremost portions of the terminals with a spacing from the terminals, and one or more electrically conductive contact pieces extending from a surface of the shield plate towards the terminals so as to be pressure-contacted with one or more of the terminals.

23 Claims, 7 Drawing Sheets

BACK-SIDE VIEW

CROSS-SECTION ALONG LINE X-X'

SHIELD CONNECTOR

FIELD OF THE INVENTION

This invention relates to a shield connector for suppressing cross-talk across terminals. More particularly, it relates to a shield connector for improving the degree of freedom in pin assignment.

BACKGROUND OF THE INVENTION

In a conventional connector, only contact units bodies (see FIG. 2) without shield plates are mounted side-by-side in a housing.

SUMMARY OF THE DISCLOSURE

In this case, the problem of cross-talk is presented because of the significant spacing between the terminals 11. If, in an attempt to overcome this problem, artifices are used as to pin assignment (conductor allocation), the degree of freedom is lowered.

It is a first object of the present invention to provide a shield connector which effectively suppresses cross-talk.

It is a second object of the present invention to provide a shield connector which improves the degree of freedom of pin assignment.

In one aspect, the present invention provides a shield connector for supporting cross-talk across terminals. The shield connector comprises: a plural number of contact units, mounted side-by-side in a housing, for arraying and holding a plural number of terminals at proper positions by insulating member(s), a plural number of electrically conductive shield plates mounted to the insulating member(s) of the contact units for extending to the vicinity of the distal ends parts of the terminals, with a spacing from the terminals, and a plural number of electrically conductive contact pieces extending from a plate surface of the shield plate towards the terminals so as to be pressure-contacted with one or more of the terminals.

Preferably, the contact pieces are pressure-contacted against the base portions of the terminals in the vicinity of the insulating member(s).

In the shield connector, each insulating member preferably extends in an area containing a point or surface in a terminal opposite to the contact point or surface between the terminal and the contact piece.

In the shield connector, each shield plate and the contact pieces are preferably formed integral with each other.

In the shield connector, the housing preferably includes insertion opening(s) passed through by the shield plate at the time of mounting the contact unit.

In the shield connector, the one or more terminals contacted with the contact pieces preferably are electrically connected to a grounding wiring provided on a substrate when the shield connector is implemented on a substrate.

In the shield connector, two or more of the contact units having different contact patterns of the contact pieces with the terminals preferably are suitably combined and mounted on the housing.

In the shield connector, the contact unit and at least one other contact unit not having the shield plate nor the contact pieces are suitably combined and mounted on the housing.

PREFERRED EMBODIMENTS OF THE INVENTION

Since the shield connector of the present invention includes a plural number of contact units, mounted side-by-side in a housing, for arraying and holding a plural number of terminals at optimum positions by insulating members, a plural number of electrically conductive shield plates mounted to the insulating member(s) of the contact units for extending to the vicinity of the distal ends of the terminals with a spacing from the terminals, and a plural number of electrically conductive contact pieces extending from the plate surface of the shield plate towards the terminals and being adapted to be pressure-contacted with one or more of the terminals, the magnetic field generated from the signal terminals is shielded by the shield plate to suppress the noise which otherwise may be produced in the neighboring terminals.

Embodiment

Figure 1A:
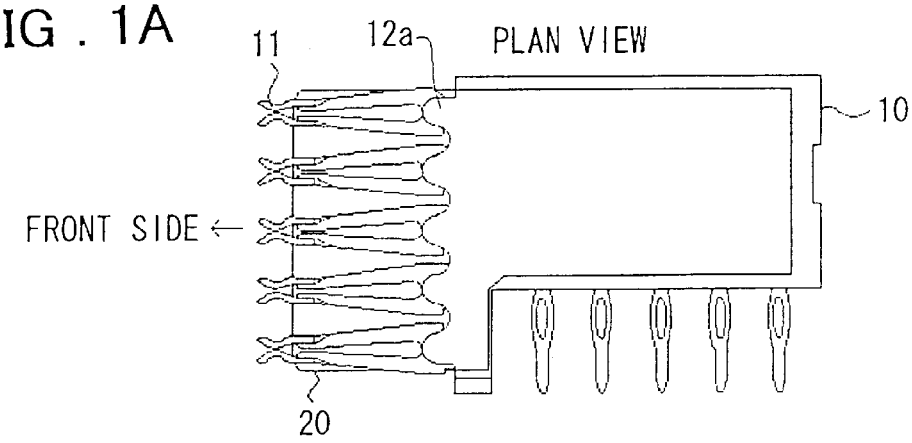
FIGS. 1A, 1B, 1C and 1D are a plan view, a bottom plan view, a back side view and a left side view, schematically showing the structure of a contact unit in the shield connector of a first embodiment of the present invention.
Figure 1B:
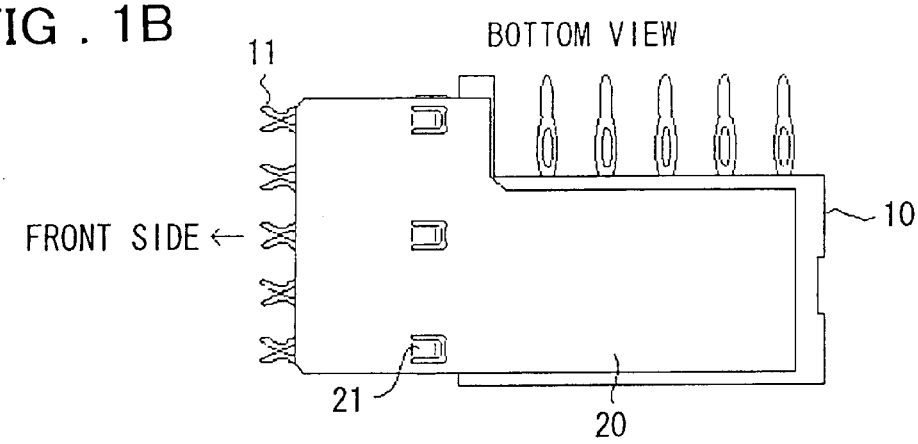
Figure 1C:
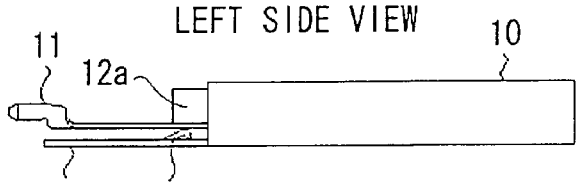
Figure 1D:
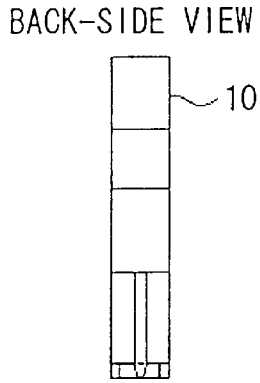
Figure 2:
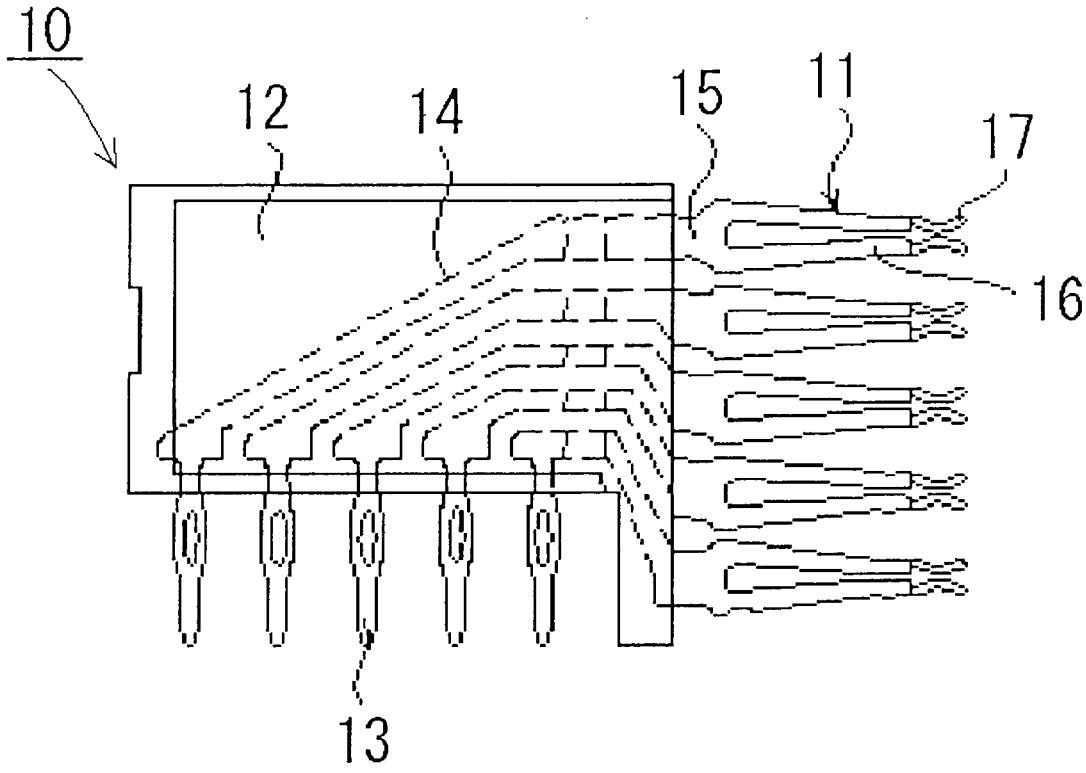
FIG. 2 is a bottom plan view schematically showing only the structure of the shield plate in the shield connector of the first embodiment of the present invention.
Figure 3:
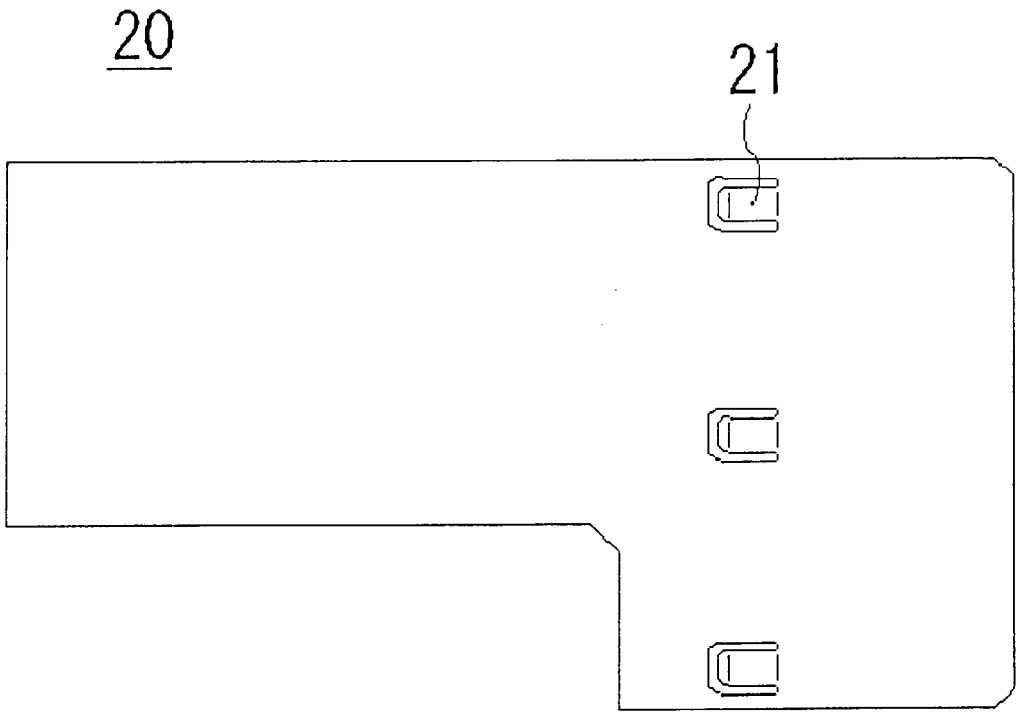
FIG. 3 is a bottom plan view schematically showing only the structure of the shield plate in the shield connector of the first embodiment of the present invention.

Referring to the drawings, certain preferred embodiments of the present invention are now explained in detail. FIGS. 1A, 1B, 1C and 1D show, in a plan view, a bottom view, a back-side view and in a left side view, a schematic structure of a contact unit in a shield connector of a first embodiment of the present invention. FIG. 2 is a bottom plan view schematically showing the structure only of a main body portion of a contact unit in a shield connector of the first embodiment of the present invention. FIG. 3 is a bottom plan view schematically showing the structure only of a shield plate in a shield connector of the first embodiment of the present invention.

Referring to FIG. 2, the contact unit 10 includes a terminal 11 and a molded member 12. Each terminal 11 is formed of an electrically conductive material, such as metal, and is comprised of an integral unit made up by a press-fitting part 13, leads 14, a base portion 15, arms 16 and contacts 17. The respective terminals 11 are arrayed side-by-side so as to be freed of contact from one another. The base portion 15 is protruded from one lateral side of the molded member 12 formed of an insulating material, while the press-fitting part 13, operating as a mounting part to e.g., a substrate, is protruded from the other lateral side of the molded member 12. The leads 14 are of different lengths depending on their arraying positions. Two bifurcated arms 16 are extended from the base portion 15 of each terminal 11. The distal ends of the respective arms 16 are provided with female contact points 17 for electrical connection with pins of male connectors, not shown, while leads 14 are mounted within the molded member 12. Although the leads 14 are embedded in the molded member 12 by an insert-molding method, it is also possible to have the leads 14 sandwiched between two mold materials. The molded member 12 is formed of an insulating resin and the shield plate 20 is mounted on the front side of the mold as seen in the drawing. In order to prevent the terminal 11 from becoming flexed under the thrusting force exerted by the contact pieces 21, the molded member 12 is adapted to extend in an area 12*a* containing the points or surfaces (planar surface) of the terminals 11 opposite to contact points or surfaces of the terminal 11 with respect to the contact pieces 21.

Referring to FIG. 3, the shield plate 20 is a rectangular metal plate and includes, in its mid portion, a plural number of the contact pieces 21 formed by segmenting (or punched out) a portion of the bulk material of the shield plate 20. The contact pieces are extended so as to be tilted towards the terminal side. When the shield plate 20 is mounted to the contact unit 10, the distal ends of the contact pieces compress (abut) against the base portion 15 of an associated terminal 11 with elasticity proper to metal material. The plate surface of the shield plate 20 is extended not only over the molded member 12, to which it is mounted, but also to the vicinity of the distal ends of the terminals 11 with a gap therefrom and laterally of a space defined between the neighboring terminals 11. The shield plate 20 is formed such as by routine press punching.

Figure 4A:
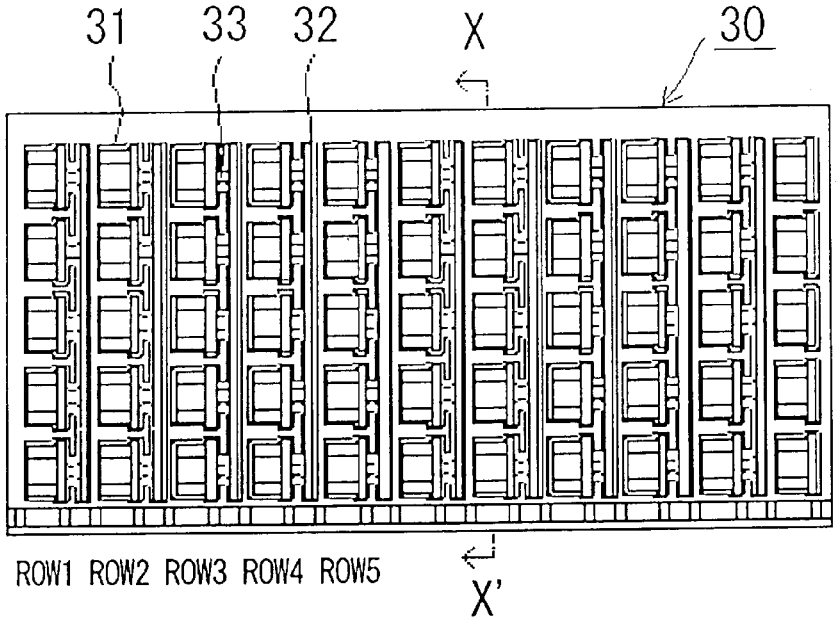
FIGS. 4A and 4B are a back side view and a cross-sectional view taken along line X–X' schematically showing a housing in a shield connector of the first embodiment of the present invention.
Figure 4B:
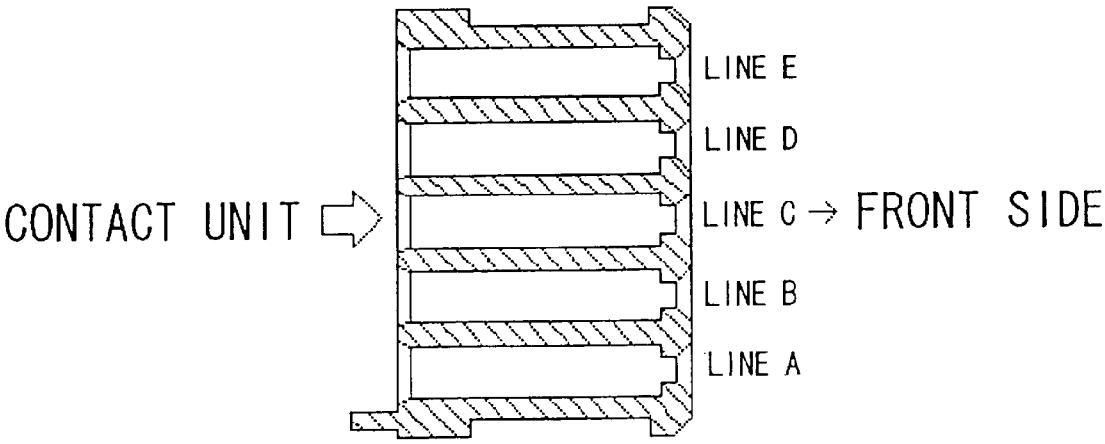

FIGS. 4A and 4B show a back-side view and a cross-section along line X–X' schematically showing a housing for a shield connector of the first embodiment of the present invention.

In a front side, not shown, of the housing 30, there are formed tapered openings for inserting pins of male connectors, in a matrix configuration, as in the case of a conventional connector. In the back side of the housing 30, terminal openings 31, into which are inserted terminals 11 of the contact unit 10, are formed in a matrix configuration in register with the front side openings. Laterally of the terminal openings 31 are formed slit openings 32 into which are introduced the shield plates 20. Between the terminal openings 31 and the slit openings 32, there are formed grooves 33 within which are accommodated the contact pieces 21 provided to the shield plate 20.

The method for manufacturing a contact unit in a shield connector of the first embodiment of the present invention is hereinafter explained.

The terminals 11 are punched from a metal sheet to a preset size and shape, using a press machine. The so punched terminals are arrayed on preset sites and molded in a nested fashion in the mold 12 by the insert molding method to complete the state of the contact unit 10.

The shield plate 20 is formed simultaneously with the contact pieces 21, by press-working a metal sheet, and is secured by fitting in the contact unit 10. This completes a shield connector. Meanwhile, there is no particular limitation to the method for securing the shield plate 20, such that an adhesive, for example, may be used.

When the shield plate 20 is mounted on the contact unit 10, the contact pieces 21 formed on the shield plate 20 are in pressure contact with a preset terminal 11, so that the terminals 11 contacted by the contact pieces 21 are at the same electrical potential with the shield plate 20.

Figure 5A:
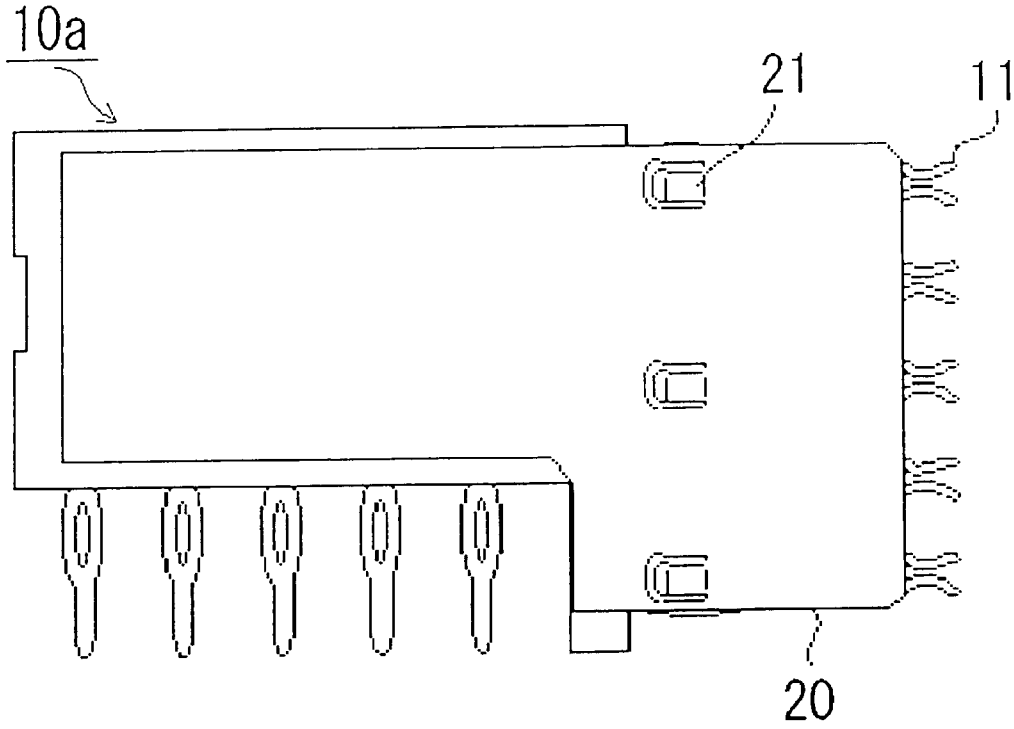
FIGS. 5A and 5B are bottom plan views schematically showing two different patterns of the contact unit in the shield connector of the first embodiment of the present invention.
Figure 5B:
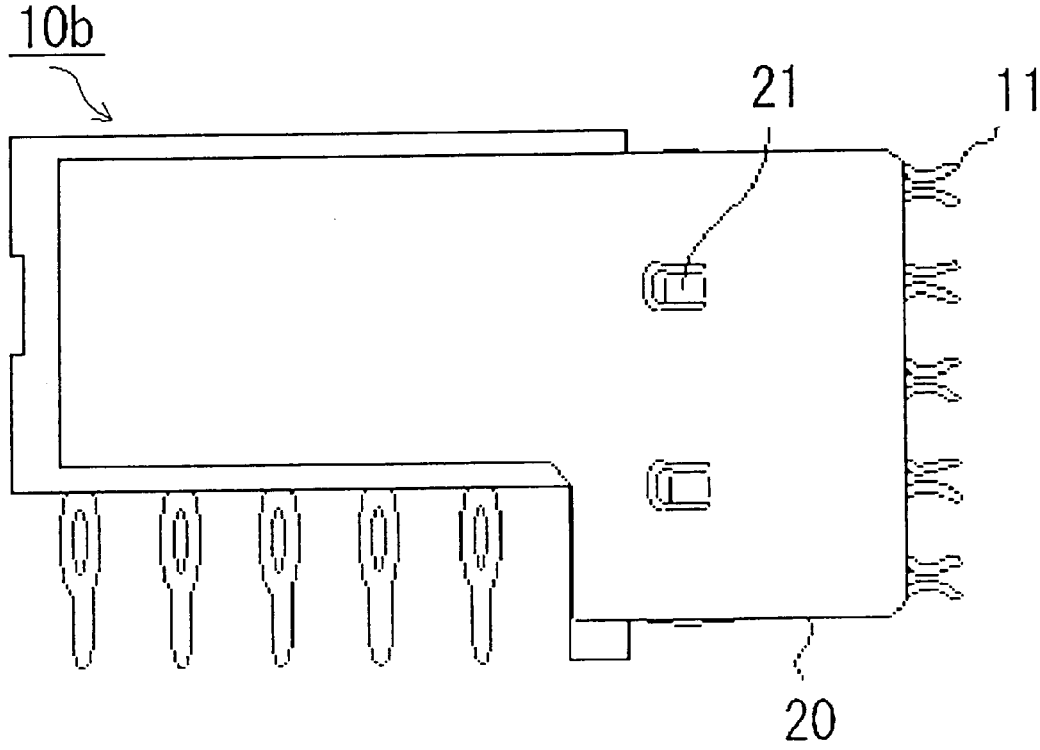
Figure 6:
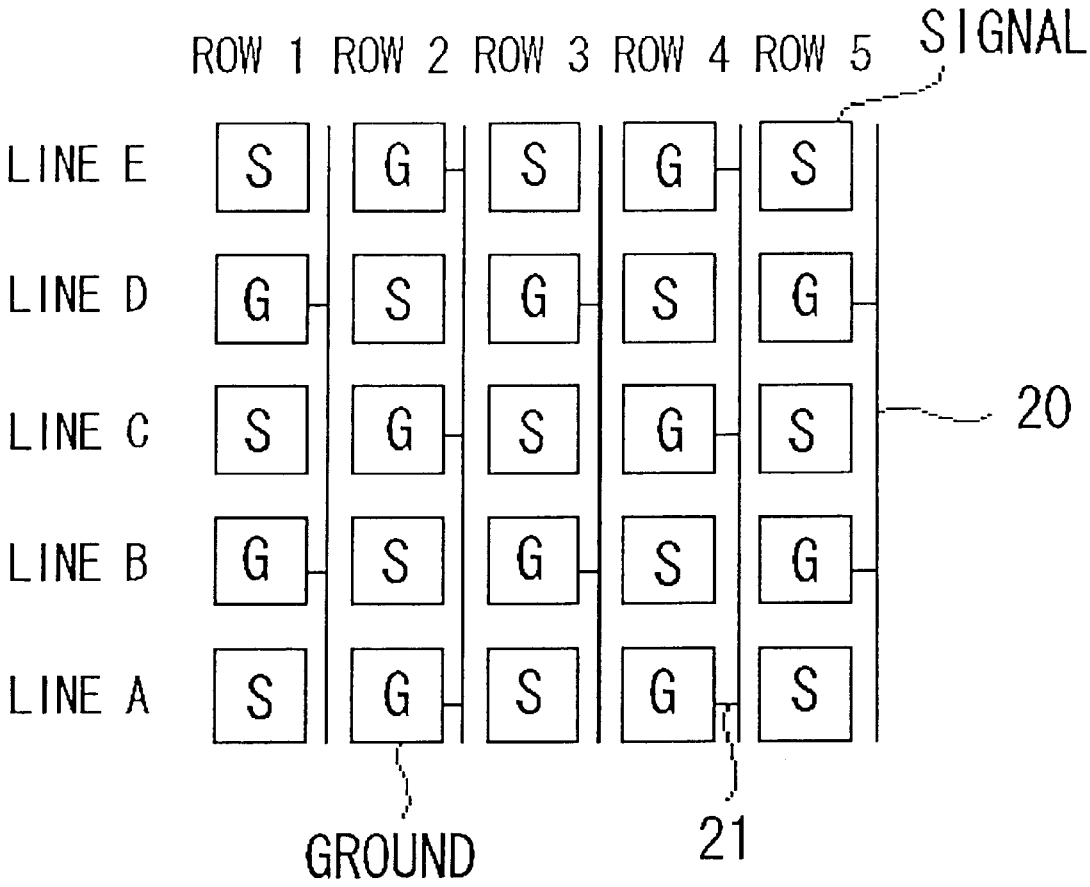
FIG. 6 is a schematic view showing pin assignment of the shield connector of the first embodiment of the present invention.

The function and the operation of the shield connector of the first embodiment are hereinafter explained. FIGS. 5A and 5B are bottom plan views schematically showing two patterns of the contact unit 10 in a shield connector according to the first embodiment of the present invention. FIG. 6 is a schematic view showing the pin assignment of the shield connector according to the first embodiment of the present invention.

Referring to FIG. 5A, a first contact unit 10*a* includes a shield plate 20 mounted on one surface of the molded member. The terminals 11 of lines A, C and E are contacted with the associated contact pieces 21 and hence are electrically connected to the shield plate 20 to operate as grounded terminals "G", while the terminals 11 of the lines B and D are not contacted with the contact pieces but operate as independent signal terminals "S".

On the other hand, referring to FIG. 5B, a second contact unit 10*b* includes the shield plate 20 on one surface of the molded member 12 in the same direction and on the same surface as those of the first contact unit 10*a*. The terminals 11 of the lines B and D are contacted with the associated contact pieces 21 and hence are electrically connected to the shield plates 20 so as to operate as grounded terminals "G", while the terminals 11 of the lines A, C and E are not contacted with the contact pieces so as to operate as independent signal terminals "S".

The schematic view of FIG. 6 shows pin assignment for such a state in which two first contact units 10*a* are introduced in rows 2 and 4, from the back side of the housing 30, and three contact units 10*b* are introduced in rows 1, 3 and 5, similarly from the back side of the housing 30. The terminals of the row 1-line E, row 1-line C, row 1-line A, row 2-line D, row 2-line B, row 3-line E, row 3-line C, row 3-line A, row 4-line D, row 4-line B, row 5-line E, row 5-line C and row 5-line A, become respective independent signal terminals "S". On the other hand, row 1-line D, row 1-line B, row 2-line E, row 2-line C, row 2-line A, row 3-line D, row 3-line B, row 4-line E, row 4-line C, row 4-line A, row 5-line D and row 5-line B become grounded terminals "G". The grounded terminals of the respective rows are electrically connected to the shield plates of the respective rows, with the grounded terminals in the respective rows being at the same electrical potential.

Although not shown, if, when the shield connector of the present embodiment is mounted on a substrate, the ground wiring provided on the substrate is electrically connected to any of the grounded terminals of the shield connector, the grounded terminals are all at the same ground potential.

In this case, the shield plates 20, electrically connected to the terminals 11, assigned as being the grounded terminals, through the contact pieces 21, are also grounded, so that the shield plates 20 are present on either (both) sides of the signal terminals, with a spacing in-between (see FIG. 6), except that there is the shield plate only on one side of the signal terminals on the leftmost or rightmost side in the shield connector. The shielding effect is higher than in the case of the grounding of the terminals of the conventional connector, thus realizing lesser crosstalk across neighboring terminals.

For example, if, in FIG. 6, signals flow through the signal terminal(s) of the row 2-line D, a magnetic field is induced around the terminal of this row 2-line D as a center. If only the main body member of the contact unit devoid of the shield plate 20 is used, the signal terminals of row 1-line E, row 3-line E, row 1-line C and row 3-line C, which are oblique direction neighbors of the row 2-line D, are affected by the magnetic field to cause electromagnetic induction thereby to produce noise. If conversely the shield plates 20 are present between the respective neighboring rows, as in FIG. 6, the magnetic field is shield off by the shield plate 20 to cause the electromagnetic induction to be produced to a lesser extent thereby to enable noise suppression.

Figure 7:
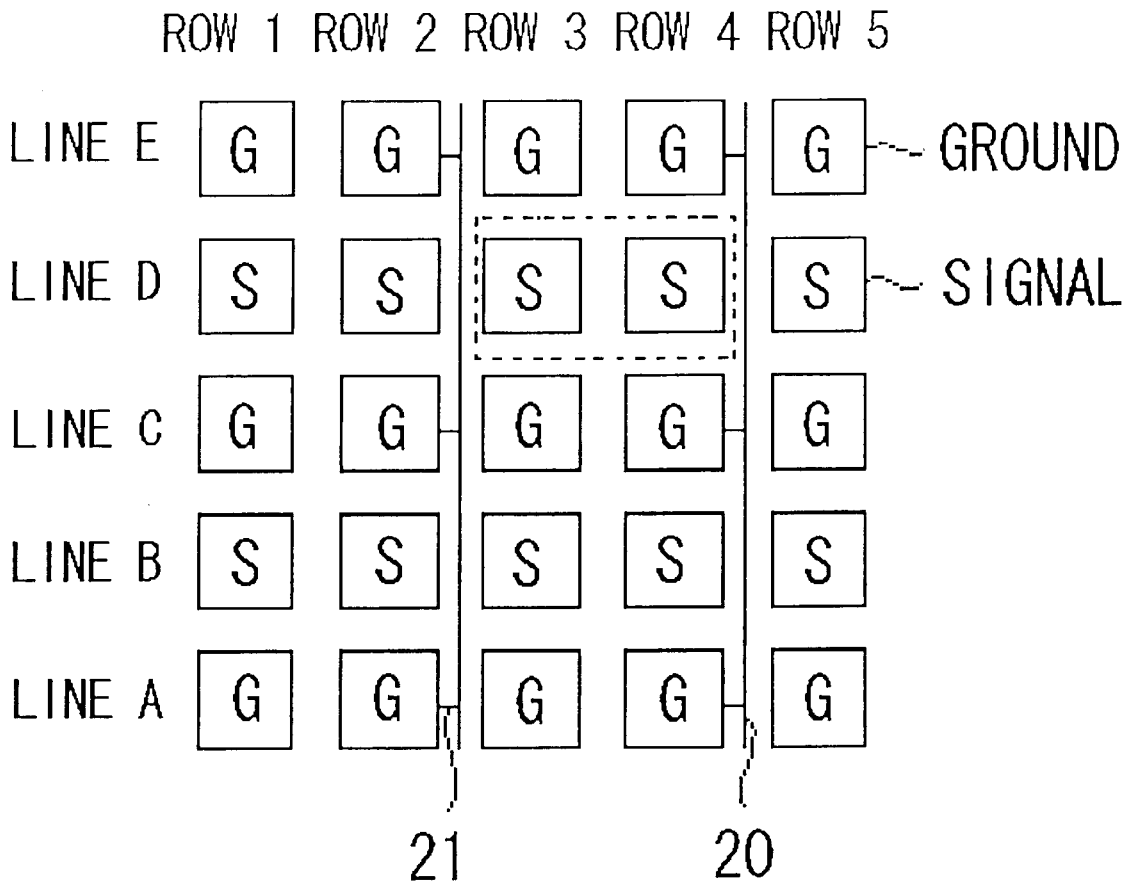
FIG. 7 is a schematic view showing pin assignment of the shield connector of the second embodiment of the present invention.

Referring to the drawings, a second embodiment of the present invention is now explained. FIG. 7 is a schematic view showing pin assignment of a shield connector according to a second embodiment of the present invention.

The pin assignment of FIG. 7 is that of a shield connector in case the contact unit 10*a* shown in FIG. 5A and the contact unit on which the shield plate shown in FIG. 2 has not been mounted are mounted to the housing 30 shown in FIG. 4. A shield connector having pin assignment as shown in FIG. 7 may be obtained on inserting two first contact units into rows 2 and 4 of the housing 30 and inserting three contact units devoid of the shield plate into rows 1, 3 and 5.

In the case of FIG. 7, the entire terminals of the lines B and D are signal terminals (S), while the entire terminals of the lines A, C and E are grounded terminals (G). Alternatively, the entire terminals of the lines B and D may be grounded terminals, with the entire terminals of the lines A, C and E then being signal terminals.

In this case, the space between neighboring terminals may be used as balanced transmission path. Moreover, since the quantity of the shield plates is halved, high speed transmission becomes possible as the cost is suppressed.

It is also possible to provide plural contact units 10 having the shield plates 20 with different positions of the contact pieces 21 to vary pin assignment of the grounded terminals on each connector.

The meritorious effects of the present invention are summarized as follows.

According to the present invention, cross-talks across respective terminals can be diminished. The reason is that the shielding effect can be increased by providing shield plate(s), electrically connected to the grounded terminals, on both sides or on one side of the signal terminals, with spacing in-between.

Moreover, by providing plural contact units, carrying shield plates, having different positions of the contact pieces, it is possible to increase the degree of freedom in the connector pin assignment (or allocation) for different potentials (e.g., signal lines an grounded lines).

In addition, if the spacing between neighboring terminals is used as a balanced transmission path, the quantity of the shield plates can be halved, so that high speed transmission becomes possible as the cost is suppressed.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A shield connector for suppressing cross-talk across terminals, comprising:

a plurality of contact units, mounted side-by-side in a housing, for arraying and holding a plurality of terminals at proper positions by an insulating member;

a plurality of electrically conductive shield plates mounted to said insulating member of said contact units for extending to the vicinity of distal ends of said plurality of terminals with a spacing from said plurality of terminals; and a plurality of electrically conductive contact pieces extending from a plate surface of the shield plate towards said terminals so as to be pressure-contacted with at least one of said plurality of terminals.

2. The shield connector as defined in claim 1, wherein said contact pieces are pressure-contacted against the base portions of said terminals in the vicinity of said insulating member.

3. The shield connector as defined in claim 1, wherein each of said insulating member extends in an area containing at least one of a point and a surface in said terminal opposite to at least of the contact point and said surface between said terminal and the contact piece.

4. The shield connector as defined in claim 1, wherein said shield plate and said contact pieces are integral with each other.

5. The shield connector as defined in claim 1, wherein said housing is provided with an insertion opening passed through by said shield plate and said contact pieces at the time of mounting the contact unit.

6. The shield connector as defined in claim 1, wherein said at least one said terminal in contact with said contact pieces is electrically connected to a grounding wiring provided on a substrate when the shield connector is implemented on said substrate.

7. The shield connector as defined in claim 1, wherein at least two of said contact units having different patterns of contact of said contact pieces with said terminals are suitably combined and mounted on said housing.

8. The shield connector as defined in claim 1, wherein said contact unit and at least one another contact unit not having said shield plate nor said contact pieces are suitably combined and mounted on said housing.

9. The shield connector according to claim 1, wherein said plurality of terminals are arrayed side-by-side without contacting each other.

10. The shield connector according to claim 1, wherein said plurality of electrically conductive contact pieces are oriented substantially parallel to said plurality of electrically conductive shield plates.

11. The shield connector according to claim 1, wherein said plurality of electrically conductive shield plates shields a magnetic field generated from said plurality of terminals.

12. The shield connector according to claim 1, wherein each of said plurality of terminals comprises an electrically conductive material.

13. The shield connector according to claim 1, wherein said insulating member comprises an insulating resin to form a molded member.

14. The shield connector according to claim 1, wherein said plurality of electrically conductive contact pieces are integrally formed with said each of said plurality of electrically conductive shield plates.

15. The shield connector according to claim 1, wherein said plurality of terminals in pressure contact with said plurality of electrically conductive contact pieces have an electrical potential the same as an electrical potential of said plurality of electrically conductive shield plates.

16. The shield connector according to claim 1, wherein at least one of said plurality of terminals comprises an independent signal terminal.

17. The shield connector according to claim 16, wherein at least one side of said independent signal terminal is surrounded by one of said plurality of electrically conductive shield plates to increase the shielding effect.

18. A shield connector for suppressing cross-talk across terminals, comprising:

a plurality of contact units, mounted side-by-side in a housing, for arraying and holding a plurality of terminals at proper positions by an insulating member;

a plurality of electrically conductive shield plates mounted to said insulating member of said contact units for extending to the vicinity of distal ends of said plurality of terminals with a spacing from said plurality of terminals; and a plurality of electrically conductive contact pieces extending from a plate surface of the shield plate towards said plurality of terminals so as to be pressure-contacted with at least one of said plurality of terminals, said contact pieces being pressure-contacted against the base portions of said plurality of terminals in the vicinity of said insulating member, and wherein each of said insulating member extends in an area containing at least one of a point and a surface in said terminal opposite to at least one of the contact point said surface between one of said plurality of terminals and the contact piece.

19. The shield connector as defined in claim 18, wherein said shield plate and said contact pieces are integral with each other.

20. The shield connector as defined in claim 19, wherein said housing is provided with an insertion opening passed through by said shield plate and said contact pieces at the time of mounting the contact unit.

21. The shield connector as defined in claim 20, wherein said terminal in contact with said contact pieces are electrically connected to a grounding wiring provided on a substrate when the shield connector is implemented on said substrate.

22. The shield connector as defined in claim 21, wherein at least two of said contact units having different patterns of contact of said contact pieces with said terminals are suitably combined and mounted on said housing.

23. The shield connector as defined in claim 22, wherein said contact unit and at least one other contact unit not having said shield plate nor said contact pieces are suitably combined and mounted on said housing.

* * * * *